US005749507A

United States Patent [19]

Wood

[11] Patent Number: 5,749,507

[45] Date of Patent: May 12, 1998

[54] CONCEALED WEAPON HOLDER

[76] Inventor: Lonnie Wood, 550 13th Pl., Vero Beach, Fla. 32960

[21] Appl. No.: 808,732

[22] Filed: Feb. 28, 1997

[51] Int. Cl.[6] ..... F41C 33/02

[52] U.S. Cl. ..... 224/587; 224/255; 224/666; 224/678; 224/912

[58] Field of Search ..... 224/587, 255, 224/912, 666, 678

[56] References Cited

U.S. PATENT DOCUMENTS

| | | | |
|---|---|---|---|
| 1,166,781 | 1/1916 | Parrish | 224/255 |
| 2,765,107 | 10/1956 | Browning | 224/255 |
| 3,315,855 | 4/1967 | Boone | 224/255 |
| 3,642,184 | 2/1972 | Hendricks | 224/255 |
| 5,012,965 | 5/1991 | Miller | 224/255 |
| 5,167,355 | 12/1992 | Hill | 224/255 |

*Primary Examiner*—Linda J. Sholl
*Attorney, Agent, or Firm*—J. Sanchelima

[57] ABSTRACT

A holder for a weapon to be concealed beneath a user's garment that includes an elongated support plate member with a base portion at one end, a central portion extending at an angle with respect to the base portion and an upper portion extending from the central portion at an angle with respect to the central portion and the upper portion being in substantial perpendicular relationship with respect to the base portion. A front guiding plate member is perpendicularly mounted to one of the lateral edges at the upper and central portions. A rear guiding plate perpendicularly is mounted to the other lateral edge on the central portion and cooperatively positioned to substantially coincide with the trigger area of said weapon. A clip assembly for removably attaching the holder to a user's garment and the clip assembly being securely mounted to said front guiding plate.

3 Claims, 2 Drawing Sheets

CONCEALED WEAPON HOLDER

BACKGROUND OF THE INVENTION

1. Field of the Invention

The present invention relates to concealed weapon holders.

2. Description of the Related Art

When guns and pistols are carried in a concealed fashion they typically get entangled with the user's garment, and in particular when a user attempts to withdraw them. Not infrequently the notorious voluminous projections reveal the concealment.

Applicant believes that the closest reference corresponds to U.S. Pat. No. 5,012,965 issued to David M. Miller in 1991. A barrel receiving member 18 is disclosed in said patent that is also used in the present invention. However, it differs from the present invention because it fails to provide the necessary supporting and sliding surface that also acts as a spacer for the garment parts that along with the two guiding members permits a user to readily retrieve the weapon. Said patented invention does not disclose either the use of a clip to secure the holder to the garment, typically a belt or waist pants.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a holder for weapons that can be used beneath a user's clothing and enables a user to readily retrieve it when desired.

It is another object of this invention to provide a concealed weapon holder that minimizes the interference of a user's clothing with the retrieval of the weapon.

It is still another object of the present invention to provide a concealed weapon holder that is light in weight, while at the same time sturdy enough to affix it to a predetermined area of a user's garment, such as the pant's waist.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
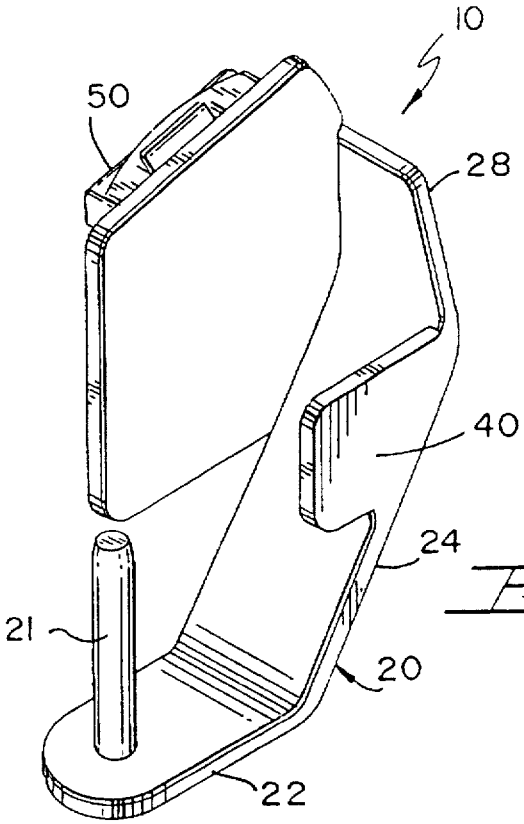
FIG. 1 represents a isometric view of the holder subject of the present application.
Figure 2:
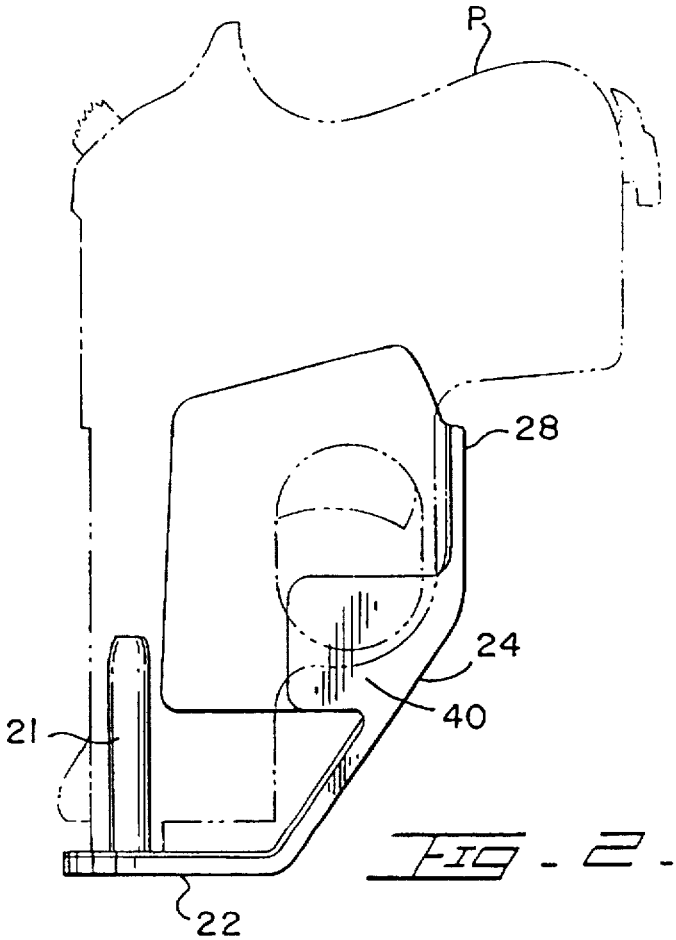
FIG. 2 shows an elevational side view of the holder with a pistol shown in phantom.

Referring now to the drawings, where the present invention is generally referred to with numeral 10, it can be observed that it basically includes an elongated support plate assembly 20, front guiding plate assembly 30 and rear guide plate assembly 40 and clip assembly 50 mounted to plate assembly 30. The dimensions of holder 10 vary depending on the caliber of the weapon.

Assembly 20 includes base portion 22 defining one end. Barrel supporting pin 21 is perpendicularly mounted to base portion 22 and has cooperative dimensions to receive the opening of a conventional weapon barrel. Assembly 20 has sufficient width to substantially match the width of pistol P to be used with holder 10. Assembly 20 acts as a spacer to permit pistol P to be readily withdrawn, when desired, with minimum entanglement with a user's garment. The central portion 24 of assembly 20 extends upwardly and rearwardly from portion 22, at an angle with respect thereto of between 120 and 150 degrees, in the preferred embodiment. The upper portion 28 of assembly 20 extends from central portion 24, at an angle that substantially makes portion 28 perpendicular with respect to base portion 22.

Pistol P rests primarily on base portion 22 and is kept in place by pin 21 and to a lesser extent the inner surface of central portion 24.

Figure 3:
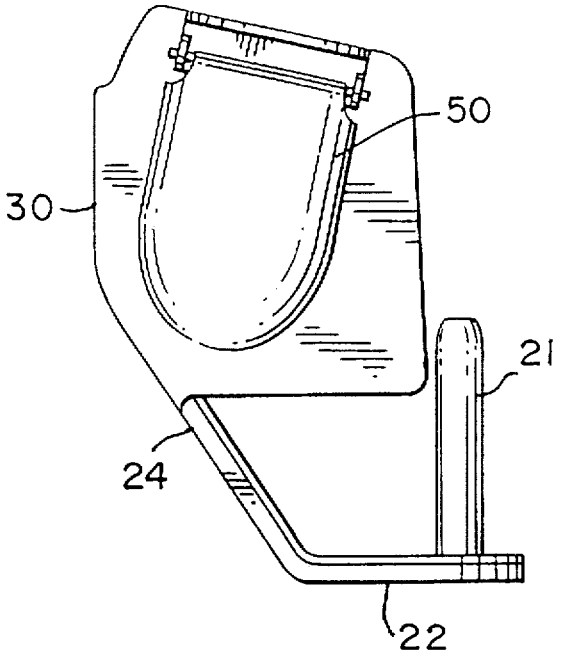
FIG. 3 illustrates an elevational view of the holder, from the side opposite to the one shown in FIG. 2.

Front guiding plate 30, as seen in FIG. 3, is perpendicularly mounted (or extends from if it is a unitary article) to the edge of central and upper portions 24 and 28, respectively. Plate 30 has sufficient area to permit clip assembly 50 to be mounted thereon and also to protect the trigger area by covering it or partially covering it and preventing the insertion of a finger therein. Even though the weapon should be locked, this added protection when a user grabs the weapon and pulls it will ensure that there will be no activation of the trigger. Clip assembly 50 is designed to removably attach to the belt or waist portion of a user's pants, in the preferred embodiment. Rear guiding plate 40 also protects the trigger area and also acts as a spacer pushing back a user's skirt and skin to make room for pistol P. It is not needed for plate 30 to cover the entire trigger area since user's fingers will not reach the trigger from this side.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A holder for a weapon with a barrel opening having a trigger to be concealed beneath a user's garment, comprising:

A. an elongated support plate member having two ends, being substantially flat and having two longitudinally extending lateral edges, and further including a base portion at one end, a central portion extending at an angle with respect to said base portion and an upper portion extending from said central portion at an angle with respect to the central portion defining the other end, and said upper portion being in substantial perpendicular relationship with respect to said base portion, and said base portion includes a supporting pin that is removably received within said opening;

B. a front guiding plate member perpendicularly mounted to one of said lateral edges on said upper and central portions;

C. a rear guiding plate perpendicularly mounted to the other lateral edge on said central portion and cooperatively positioned to substantially coincide with the trigger area of said weapon;

D. clip means for removably attaching said holder to a user's garment and said clip means being securely mounted to said front guiding plate.

2. The holder set forth in claim 1 wherein said front guiding plate member has cooperative dimensions to cover the trigger when said weapon is in said holder.

3. The holder set forth in claim 1 wherein said trigger is partially covered by said front guiding plate.

* * * * *